US005195741A

United States Patent [19]

Stauber

[11] Patent Number: 5,195,741

[45] Date of Patent: Mar. 23, 1993

[54] APPARATUS FOR SELECTIVELY TRANSFERRING PRODUCTS FROM AN IMBRICATED FORMATION CONVEYED ALONG A FIRST CONVEYING PATH ONTO A SECOND CONVEYING PATH

[75] Inventor: Hans-Ulrich Stauber, Grüt, Switzerland

[73] Assignee: Ferag AG, Hinwil, Switzerland

[21] Appl. No.: 769,835

[22] Filed: Oct. 2, 1991

[30] Foreign Application Priority Data

Oct. 4, 1990 [CH] Switzerland ..... 03197/90

[51] Int. Cl.[5] ..... B65H 29/66

[52] U.S. Cl. ..... 271/303; 271/285

[58] Field of Search ..... 271/216, 300, 302, 303, 271/285, 286

[56] References Cited

U.S. PATENT DOCUMENTS

| | | | |
|---|---|---|---|
| 2,815,949 | 12/1957 | Faeber | 271/303 |
| 4,302,198 | 11/1981 | Kawada | 271/303 |
| 4,566,582 | 1/1986 | Linder . | |
| 4,582,227 | 4/1986 | Miller . | |
| 4,953,843 | 9/1990 | Reist | 271/303 |
| 5,143,369 | 9/1992 | Meiseh et al. | 271/303 |

FOREIGN PATENT DOCUMENTS

| | | | |
|---|---|---|---|
| 133102 | 3/1946 | Australia | 271/303 |
| 2820957 | 12/1978 | Fed. Rep. of Germany . | |
| 2200831 | 4/1974 | France . | |
| 566925 | 9/1975 | Switzerland . | |

*Primary Examiner*—Robert P. Olszewski
*Assistant Examiner*—Steven M. Reiss
*Attorney, Agent, or Firm*—Oblon, Spivak, McClelland, Maier & Neustadt

[57] ABSTRACT

The conveying device comprises a first conveyor to feed printed products, arranged in an imbricated formation and arriving in a predetermined conveying direction, to an outfeed conveyor. In order to separate or detach printed products from this imbricated formation and supply the separated printed products to a second conveyor, there is provided a transfer or carry-over conveyor comprising two conveying arms pivotably connected to one another and arranged in tandem. The first conveying arm is stationarily mounted at its conveying-active end, and a reciprocating pivotable driving lever acts upon the second conveying arm for the purpose of shifting a conveying entrance of the transfer or carry-over conveyor from a working position, in which the printed products are supplied to the second conveyor, to a withdrawal position and again back to the working position. A pressing belt or band, common to both conveying arms, is guided around respective rolls or rollers such that the pressing belt or band, as viewed in the conveying direction of the transfer or carry-over conveyor, is not displaced with respect to the conveying arms, irrespective of the pivoting or swivel position of the conveying arms.

16 Claims, 3 Drawing Sheets

APPARATUS FOR SELECTIVELY TRANSFERRING PRODUCTS FROM AN IMBRICATED FORMATION CONVEYED ALONG A FIRST CONVEYING PATH ONTO A SECOND CONVEYING PATH

BACKGROUND OF THE INVENTION

1. Field of the Invention

The present invention broadly relates to infeeding and outfeeding substantially flat products arranged in an imbricated or shingled formation and, more specifically, pertains to a new and improved apparatus for selectively or alternatively transferring flexible flat products, especially printed products such as newspapers, magazines and the like, from an imbricated formation or array conveyed along a first conveying path onto a second conveying path.

Generally speaking, the apparatus of the present invention is of the type comprising a first conveyor defining the first conveying path, a second conveyor defining the second conveying path, and a transfer or carry-over conveyor provided between the first conveyor and the second conveyor, the transfer or carry-over conveyor having a conveying entrance facing the first conveyor and a stationary conveying exit facing the second conveyor. The transfer or carry-over conveyor comprises two conveying arms arranged in tandem, pivotably connected with each other and structured as a belt conveyor. The two conveying arms constitute a first conveying arm and a second conveying arm. The first conveying arm, having a conveying-active end, is located directly upstream of the second conveyor and stationarily pivotably mounted in the region of the conveying-active end. There is also provided a driving arrangement, by means of which both conveying arms are pivotable in knee-like manner, in order to take the aforesaid conveying entrance provided at the free end of the second conveying arm to a working position, disposed in neighboring relationship to the first conveyor, for the purpose of separating printed products from the imbricated formation, and to take the conveying entrance to a withdrawal position remote from the first conveyor for the purpose of terminating the separation of printed products from the imbricated formation. Furthermore, pressing means, having at least one endless revolving pressing or hugger belt or band, are allocated to the two conveying arms for the purpose of forming a conveying gap in conjunction with the two conveying arms.

2. Discussion of the Background

Such an apparatus is known, for example, from U.S. Pat. No. 2,815,949, granted Dec. 10, 1957. The apparatus disclosed therein comprises two conveying arms which are pivotably connected with each other and provided with respective endless revolving tapes or belts guided around rolls, which are mounted at a common shaft provided at the pivot connection of the two conveying arms. The first conveying arm is stationarily mounted at its conveying-active end which is remote from the second conveying arm. The second conveying arm is guided at its free end in a curved slide. The operating arm of an air cylinder anchored to a bottom support is joined to the aforesaid common shaft at which the rolls are supported, so that by lowering the shaft, the free end of the second conveying arm, i.e. the conveying entrance with a pick-up nose in the form of a scoop, is brought into the conveying path of a first belt conveyor, and the printed products, inbound in an imbricated formation on this first belt conveyor, are fed to a belt conveyor arranged downstream of the transfer conveyor formed by the two conveying arms. Upon raising the shaft by means of the operating arm of the air cylinder, the transfer conveyor is bent in a knee-like manner and the conveying entrance is retracted from the conveying region of the first belt conveyor. The inbound printed products reposing on the first belt conveyor are again further conveyed by the latter. Above the two conveying arms, there are arranged pressing means comprising two pivotably connected pressing elements, which are structured in a conveyor belt-like manner and have respective endless revolving pressing tapes or belts. These pressing tapes or belts, forming a conveying gap in conjunction with the respective endless revolving tapes or belts of the conveying arms, are guided about rolls having a common axis located at the pivot connection of the two pressing elements. A rod slidably supported by both a pivoted guide and an assembly mounting the rolls having the common axis, is joined to the aforesaid common shaft from above. This rod, together with a spring assembly joined thereto, is provided for cooperation between the pairs of tapes of the transfer or carry-over conveyor. Side members supporting the rolls of the conveying arms and supporting members for mounting the rolls of the pressing elements are joined by means of angularly disposed links.

This known construction of a transfer or carry-over conveyor is disadvantageous in that the conveying gap varies according to the pivoting position of the conveying arms not only as to its position relative to the conveying arms, but also with respect to its height or gap clearance. As a result, the printed products can be displaced with respect to their mutual position during the pivoting movement of the conveying arms such that further cyclical or cadenced processing of the printed products is rendered impossible in most cases. Furthermore, very thin printed products or the like are not correctly held in the conveying gap of this known transfer conveyor. However, since the products designated as signatures are supplied alternatively to two so-called jogger boxes, it is conceivable that the mutual position of the signatures outbound to the one or other jogger box is of no account.

An apparatus serving essentially the same purpose but relatively different in construction and design is known from, for example, German Patent Application No. 2,820,957, published Dec. 7, 1978. This prior art construction comprises a first conveyor provided with two belt conveyors arranged in tandem and elevationally offset or staggered for transporting printed products arranged in a imbricated array along a first conveying path. Between this first conveying path and a second conveying path, there is provided a transfer or carry-over conveyor for the purpose of separating individually or in groups the printed products conveyed in the imbricated array over the step formed by the two elevationally offset belt conveyors, and for the purpose of feeding the separated product or products to the second conveying path. As viewed in the conveying direction, the transfer or carry-over conveyor, which is arranged downstream of the aforesaid step and conveys the separated product or products in an inclinedly upward direction, comprises two stationary guide rods and a carriage which is telescopingly displaceable thereat. Two conveyor belts, the contiguous conveying-active runs of which form a conveying gap and extend from rolls arranged at the bottom end of the carriage to rolls mounted at the upper end of the stationary guide rods, are guided with their return runs around further rolls provided at the bottom end of the stationary guide rods and at the upper end of the carriage, in order to compensate for variations of the length of the conveying-active runs during displacement of the carriage. At the lower end of the carriage there is pivotably mounted a tongue or blade directed towards the step. When the carriage is in its lower end position and the tongue or blade is upwardly pivoted, the imbricated formation of printed products is conveyed under the transfer or carry-over conveyor and along the first conveying path. On the other hand, when the tongue or blade is pivoted downwardly, it deflects from below the printed product conveyed over the step and conducts the printed product to the conveying gap of the transfer or carry-over conveyor.

As soon as the last printed product to be fed onto the second conveying path has been deflected and seized by the conveying gap, the carriage is upwardly retracted and the tongue or blade is subsequently pivoted in the upward direction for the purpose of separating this last printed product from the next following or trailing printed product. The speed of the upward movement of the carriage is thereby lower than the revolving speed of the conveyor belts. This revolving speed, especially in the case of separation of printed products in groups from the imbricated formation, is equal to the conveying speed of the first conveyor. As a result, the two printed products to be separated or detached from one another are conveyed at very much the same speed, and the next following or trailing printed product, which is gripped from below by the preceding or leading printed product held by the two conveyor belts, is raised in the upward direction and entrained by virtue of friction or, as the case may be, displaced or shifted out of its position with respect to the other printed products arranged in the imbricated formation.

SUMMARY OF THE INVENTION

Therefore, with the foregoing in mind, it is a primary object of the present invention to provide a new and improved apparatus for selectively transferring printed products from an imbricated formation conveyed along a first conveying path onto a second conveying path, and which does not exhibit the aforementioned drawbacks and shortcomings of prior art constructions.

Another and more specific object of the present invention aims at providing a new and improved apparatus of the character described and which is particularly capable of retaining or maintaining the mutual position of the printed products to be supplied to the aforesaid second conveying path, irrespective of the position, i.e. the momentary pivoting or swivel position, of the transfer or carry-over conveyor.

Yet a further significant object of the present invention aims at providing a new and improved apparatus for selectively or alternatively transferring printed products from an imbricated formation conveyed along a first conveying path onto a second conveying path and which apparatus comprises a transfer or carry-over conveyor composed of relatively simple structural elements which have proven themselves in practical utilization and can be readily and reliably adjusted.

Now in order to implement these and still further objects of the invention, which will become more readily apparent as the description proceeds, the apparatus of the present invention is manifested, among other things, by the features that there are provided means for guiding and retaining the pressing means, i.e. the at least one endless revolving pressing or hugger belt or band, in the conveying direction of the transfer or carry-over conveyor such that the pressing means retain their position with respect to the two conveying arms, irrespective of the pivoting or swivel position of the two conveying arms.

The two conveying arms structured as a belt conveyor advantageously comprise a common revolving endless conveyor belt or band.

The conveying-active run of this common revolving endless conveyor belt or band is guided around a deflection roller located in the region of the pivot or joint-like connection of the two conveying arms.

The aforesaid at least one endless revolving pressing or hugger belt or band of the pressing means constitutes a pressing or hugger belt or band common to both conveying arms, the pressing-active run thereof bearing upon the conveying-active run of the common revolving endless conveyor belt or band for the purpose of forming a conveying gap.

The conveying arms comprise respective bearing shields for the purpose of supporting rolls or rollers for the common revolving endless conveyor belt or band, whereby the the bearing shields of the second conveying arm are pivotably mounted at the bearing shields of the first conveying arm. The aforesaid guiding and retaining means comprise linkage means structured as links or brackets and pivotably acting at one end thereof upon the bearing shields related to the first conveying arm. These guiding and retaining means further comprise bearing members pivotably arranged at the other end of the linkage means, means for pre-biasing these bearing members in the direction towards the respective conveying arms, whereby the bearing members are structured in a shield-like manner and, in the lengthwise direction of the bearing shields, are substantially stationary with respect to the latter, and rolls or rollers provided at the bearing members, at connection locations of the linkage means with the bearing shields related to the first conveying arm, and at connection locations of the linkage means with the respective bearing members. The pressing or hugger belt or band related to both conveying arms is guided around these rolls or rollers of the guiding and retaining means.

The driving arrangement advantageously comprises a drivable driving lever for the purpose of moving the conveying arms. This driving lever has oppositely situated ends and is stationarily pivotably mounted at one end thereof and at the other end thereof acts upon the second conveying arm or, as the case may be, upon one of the bearing shields of the second conveying arm.

The first conveyor is structured as a belt conveyor, the upper conveying-active run of which first wraps around a stepped or shoulder roll and then in the opposite direction around a deflection roll for the purpose of forming a descending step as viewed in the predetermined conveying direction, thereby exposing or laying bare the leading edge or region of the respective printed product momentarily conveyed over the descending step. The upper conveying-active run is preferably arranged to ascend towards the stepped or shoulder roll, and the conveying entrance of the transfer or carry-over conveyor which is taken to the working position for the purpose of seizing the printed product momentarily conveyed over the descending step, is arranged in neighboring relationship to and downstream of the descending step, as viewed in the predetermined conveying direction.

A retaining device is provided for preventing entrainment of printed products which are not seized by the second conveying arm while taking the two conveying arms from a location corresponding to the working position of the conveying entrance back to a location corresponding to the withdrawal position of the conveying entrance. The retaining device advantageously comprises a pressing element co-acting with the upper conveying-active run of the first conveyor.

Subsequent to the separation of the last printed product to be supplied to the second conveyor from the imbricated formation conveyed by means of the first conveyor, the two conveying arms can be transferred from the location corresponding to the withdrawal position of the conveying entrance to a stand-by position, in which the conveying entrance is located in the proximity of the working position thereof.

Driving means are provided for driving the first conveyor at a predetermined conveying speed. The conveying arms structured as a belt conveyor are driven at a conveying speed substantially corresponding to the predetermined conveying speed. The speed of movement at which the driving arrangement takes the conveying entrance from the working position to the withdrawal position thereof advantageously exceeds the predetermined conveying speed.

The driving means advantageously constitute a common drive which is connected with the first conveyor, the second conveyor, and both conveying arms for the purpose of conveying the printed products at the same predetermined conveying speed.

Additionally, the common drive is advantageously connected with the pressing or hugger belt or band of the pressing means, and with the pressing element of the retaining device.

BRIEF DESCRIPTION OF THE DRAWINGS

The invention will be better understood and objects other than those set forth above will become apparent when consideration is given t the following detailed description thereof. Such description makes reference to the annexed drawings wherein throughout the various figures of the drawings, there have been generally used the same reference characters or numerals to denote the same or analogous components and wherein.

DESCRIPTION OF THE PREFERRED EMBODIMENTS

Describing now the drawings, it is to be understood that to simplify the showing thereof, only enough of the construction of the apparatus for selectively or alternatively transferring printed products from an imbricated formation conveyed along a first conveying path onto a second conveying path, has been illustrated therein as is needed to enable one skilled in the art to readily understand the underlying principles and concepts of this invention.

Figure 1:
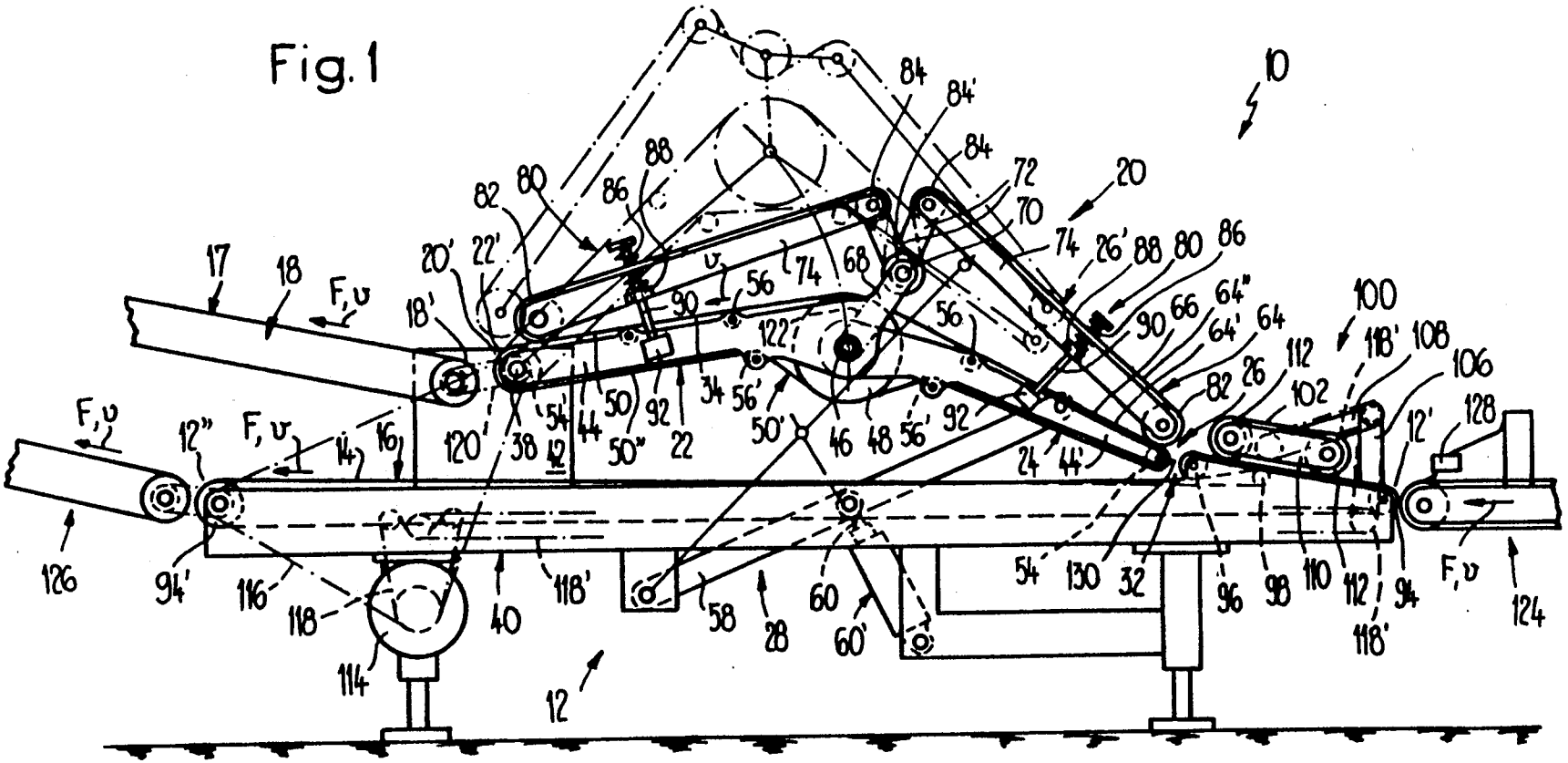
FIG. 1 schematically shows in a side view a switch-like conveying device constructed according to the invention.
Figure 2:
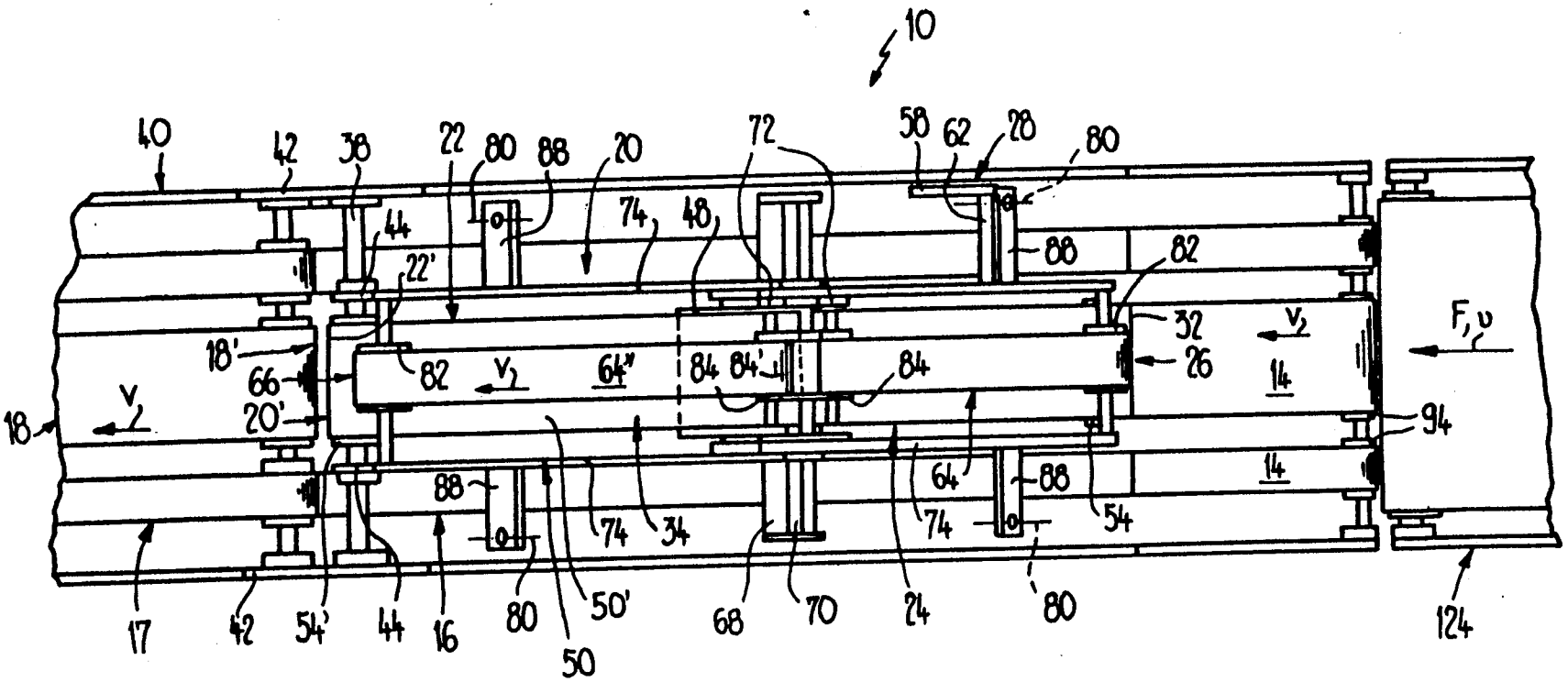
FIG. 2 schematically shows in a top plan view the conveying device according to FIG. 1.

Turning attention now specifically to FIGS. 1 and 2 of the drawings, a switch-like conveying device 10 illustrated therein by way of example and without limitations will be seen to comprise a first conveyor 12 structured as a belt conveyor, the upper conveying-active run 14 of which extends along a first conveying path 16. The conveying direction of the first conveyor 12 has been indicated by an arrow F. The first conveyor 12 has a beginning or front end 12' and a rear end 12'', as viewed in the conveying direction F. Above this first conveyor 12 there is provided a second conveyor 18 likewise structured as a belt conveyor and defining a second conveying path 17. This second conveyor 18 has a beginning or front end 18' which is located between the beginning or front end 12' and the rear end 12'' of the first conveyor 12. For reasons of simplicity, the rear end of the second conveyor 18 is not particularly shown in the drawings. Between the first conveyor 12 and the second conveyor 18, there is provided a transfer or carry-over conveyor 20 which is also structured as a belt conveyor and comprises two conveying arms 22 and 24 arranged in tandem and pivotably connected to each other. The two conveying arms 22 and 24 constitute a first conveying arm 22 and a second conveying arm 24. The transfer or carry-over conveyor 20 comprises a stationary conveying exit or way out 20' and a conveying entrance or entry 26. The stationary conveying exit or way out 20' is arranged directly upstream of the beginning or front end 18' of the second conveyor 18 as viewed in the conveying direction F. A driving arrangement 28 acts upon the second conveying arm 24 such that both conveying arms 22 and 24 are pivotable in a knee-like manner to take the conveying entrance 26 from a working position shown in FIG. 1 by full or unbroken lines, to a withdrawal position 26' indicated by dot-dash lines, and again back to the working position. Printed products 30 such as newspapers, magazines and the like, arranged in an imbricated or shingled formation S, as depicted in FIGS. 3 through 7, are conveyed in the conveying direction F along the first conveying path 16 when the conveying entrance 26 is located in the withdrawal position 26' thereof.

In order to divert printed products 30 from the first conveying path 16 onto the second conveying path 17, the conveying entrance or entry 26 of the transfer or carry-over conveyor 20 is brought to the working position which, as viewed in the conveying direction is disposed in neighboring relationship to and downstream of a step 32 formed by the upper run 14 of the first conveyor 12, so that respective leading or downstream edges 30' of the printed products 30 conveyed over the step 32 run into the conveying entrance 26. The thus diverted printed products 30 are conveyed along a conveying stretch or route 34 of the transfer or carry-over conveyor 20 to the conveying exit 20' and supplied to the second conveyor 18. It is thereby to be observed that the conveying stretch or route 34 is substantially constant or invariable, irrespective or independent of the pivoting or swivel position assumed by the two coveying arms 22 and 24.

As soon as the desired number of printed products 30 to be diverted onto the second conveying path 17 have entered the conveying entrance 26, the two conveying arms 22 and 24 are pivoted by means of the driving arrangement 28, thereby taking back the conveying entrance 26 to the withdrawal position 26' thereof, whereby the last printed product 30 seized by the conveying entrance 26 is drawn off from under the next following or upstream printed product 30. This next following or upstream printed product 30 and all following inbound printed products 30 are then again further conveyed along the first conveying path 16.

The first conveying arm 22 comprises a conveying-active end 22' and is stationarily mounted in the region of such conveying-active end 22'. For this purpose, a shaft 38 is stationarily rotatably mounted at supporting plates 42 which upwardly extend from a stand or frame 40 of the first conveyor 12. Only one of the two supporting plates 42 is shown in the side view of FIG. 1. At this shaft 38, there are provided two bearing shields 44 extending substantially parallel to one another and arranged in a spaced relationship in the direction of the shaft 38, whereby these bearing shields 44 are pivotably arranged at one end thereof and serve at the other end thereof for pivotably supporting respective bearing shields 44' of the second conveying arm 24. For this purpose, the two bearing shields 44 are connected in the region of their respective free ends by means of a bearing shaft 46, at which the bearing shields 44', with their respective free-end regions situated on this side, are pivotably seated. A deflection roller 48 is seated at the bearing shaft 46 to be freely rotatable between the bearing shields 44 and 44'. A conveyor belt or band 50', common to the conveying arms 22 and 24, comprises an upper conveying-active run 50 which is guided around the aforesaid deflection roller 48. The conveyor belt or band 50' trains or wraps around a roll or roller 54 freely rotatably mounted at respective free ends of the bearing shields 44', and around a driven roll or roller 54' sitting on the shaft 38. The conveying-active run 50 is carried by supporting rollers 56 which are provided between the deflection roller 48 and the rolls or rollers 54 and 54' and likewise mounted at the bearing shields 44 and 44', respectively. Further supporting rollers 56' are provided at the pair of bearing shields 44 and the pair of bearing shields 44', respectively, these supporting rollers 56' being disposed in neighboring relationship to the deflection roller 48. The return run 50'' of the conveyor belt or band 50' is guided around the supporting rollers 56', in order to ensure that the return run 50'' bears against and wraps around the deflection roller 48.

The driving arrangement 28 comprises a driving lever 58 which is stationarily pivotably mounted at the stand or frame 40. At the other end thereof, the driving lever 58 is pivotably connected to the central portion of one of the bearing shields 44' which, as viewed in the conveying direction F, is the right bearing shield 44', as depicted in FIG. 2. A piston-and-cylinder unit 60', appropriately mounted at the stand or frame 40, comprises a piston rod 60 which centrically acts upon the driving lever 58. When the piston rod 60 is retracted in the piston-and-cylinder unit 60', the conveying arms 22 and 24 are in an almost stretched position which corresponds with the working position of the conveying entrance 26. By extending the piston rod 60 of the piston-and-cylinder unit 60', the driving lever 58 is pivoted to the position depicted by dot-dash lines in FIG. 1, whereby the conveying arms 22 and 24 are pivoted towards one another in toggle lever-like manner, in order to take or transfer the conveying entrance 26 to the withdrawal position 26' thereof.

As best seen by referring to FIG. 2, the transfer or carry-over conveyor 20 is narrower than the first conveyor 12 and the second conveyor 18, as viewed in the direction transverse to the conveying direction F. In order not to obstruct the printed products 30 to be conveyed along the first conveying path 16, a supporting arm or lug 62 projects from the aforesaid right bearing shield 44', as viewed in the conveying direction F, and the driving lever 58 extending beyond or outside of the conveying range of the first conveyor 12 acts upon the supporting arm or lug 62 to move the right bearing shield 44' and thus the conveying arms 22 and 24.

In order to appropriately retain or hold the printed products 30, which are to be supplied to the second conveyor 18, at the upper conveying-active run 50 irrespective of the pivoting or swivel position of the conveying arms 22 and 24, there is provided a pressing or hugger belt or band 64 comprising a lower pressing-active run 64' which bears against the upper conveying-active run 50 and forms an appropriate conveying gap 66 in conjunction with the latter. At the two bearing shields 44 of the first conveying arm 22, there are formed respective arms 68 which are disposed in neighboring relationship to the bearing shaft 46. These arms 68 are bent away outwards and extend in a substantially upright direction. The free ends of these arms 68 are connected by a further shaft 70 located above the conveying-active run 50 and the pressing-active run 64'. At this further shaft 70, there are pivotably mounted two pairs of links or brackets 72, the free ends of which being pivotably connected to respective bearing members or plates 74 formed as bearing shields or equivalent structure.

The bearing members or plates 74 are appropriately pre-biased or loaded by means of respective spring arrangements 80 in the substantially downward direction and thus towards the bearing shields 44 and the bearing shields 44'. These bearing members or plates 74 have end portions remote from the two pairs of links or brackets 72. In other words, the end portions are in the region of the conveying entrance 26 and in the region of the conveying exit 20', respectively. Rolls or rollers 82 are freely rotatably mounted at these end portions of the bearing members or plates 74, the pressing or hugger belt or band 64 being guided around these rolls or rollers 82. From the rolls or rollers 82, the pressing or hugger belt or band 64 extends with its return run 64'' along the bearing members or plates 74 to further rolls or rollers 84 provided at the link joints between the bearing members or plates 74 and the pairs of links or brackets 72. After partially wrapping around these further rolls or rollers 84, the return run 64'' extends to a roll or roller 84' freely rotatably mounted at the further shaft 70.

The spring arrangements 80 provided in the middle sections or regions of the two bearing shields 44 and the two bearing shields 44' comprise respective pressure springs 86 having oppositely situated ends. Respective lower ends of these pressure springs 86 are supported at respective supports or brackets 88 which outwardly protrude from the bearing members or plates 74. Respective upper ends of these pressure springs 86 are supported at respective tension rods 90. These tension rods 90 piercingly extend through the related pressure springs 86 and the associated supports or brackets 88 and, with their lower ends, are supported or secured at further supports or brackets 92 which outwardly protrude from the bearing shields 44 and the bearing shields 44', respectively. The tension rods 90 are stationarily arranged relative to their associated bearing shields 44 and 44', so that the position of the bearing members or plates 74, as viewed in the lengthwise direction of the bearing shields 44 and 44', is appropriately determined or fixed. Upon mutual pivoting of the conveying arms 22 and 24, the pairs of links or brackets 72 mutually or reciprocally pivot about the further shaft 70, so that the length of the endless pressing or hugger belt or band 64 remains constant or invariable, irrespective of the position assumed by the two conveying arms 22 and 24.

The conveying-active upper run 14 of the first conveyor 12 structured as a belt conveyor extends from a deflection roller 94, which is located at the beginning or front end 12' and freely rotatably mounted in a known manner at the stand or frame 40, in gently ascending manner to a stepped or shoulder roll 96 as viewed in the conveying direction F, and from this stepped roll 96 in the opposite direction to a deflection roll or roller 98. Subsequent to wrapping around this deflection roll or roller 98, the conveying-active upper run 14 again extends in the conveying direction F to pass below the stepped roll 96 to a further deflection roller 94' located at the end or rear end 12'' of the first conveyor 12.

A retaining or hold-back device 100 is provided between the stepped or shoulder roll 96 and the deflection roller 94 and in arranged, as viewed in the conveying direction F, directly upstream of the descending step 32. This retaining or hold-back device 100 comprises an endless press or pressing belt 102 which co-acts with the conveying-active upper run 14 of the first conveyor 12. A supporting arm 106 projects from the stand or frame 40 in a substantially upright direction. At the upper end of this supporting arm 106 there is mounted a weight-loaded or weight arm 108, at the free end of which there are provided shield-like bearing brackets 110 attached approximately half-way between their ends to the weight-loaded or weight arm 108. At these ends of the bearing brackets 110, there are mounted respective deflection rolls or rollers 112, around which the endless press or pressing belt 102 is guided. The lower run of the endless press or pressing belt 102 facing the conveying-active upper run 14 of the first conveyor 12, forms conjointly with the latter a conveying gap for the printed products 30, in order to prevent the printed product 30, which is not seized by the transfer conveyor 20 upon return pivoting of the conveying entrance 26 from the working position to the withdrawal position 26', from being entrained.

A suitable driving motor 114 is also arranged at the stand or frame 40. This driving motor 114 is connected by means of a first chain drive 116, indicated in FIG. 1 by dot-dash lines, with the deflection roller 94' for the purpose of driving the conveyor belt of the first conveyor 12, and with the roll or roller 54' for the purpose of driving the conveyor belt or band 50' of the transfer or carry-over conveyor 20. A further chain drive 118, coupled with the driving motor 114, drives the endless press or pressing belt 102 via several downstream chain drives 118' likewise depicted by dot-dash lines. Furthermore, the second conveyor 18 is driven by the driving motor 114 via a chain drive 120, indicated in dot-dash lines. This chain drive 120 is coupled in known manner with the shaft 38 driven by the first chain drive 116. The deflection roller 48, driven by the conveyor belt or band 50', is coupled with the freely rotatable roll or roller 84' by means of a further chain drive 122 also only depicted by dot-dash lines. In this manner, the pressing or hugger belt or band 64 is synchronously driven with the conveyor belt or band 50'. All belt conveyors of the switch-like conveying device 10, namely the first conveyor 12, the second conveyor 18, the conveyor belt or band 50', the pressing or hugger belt or band 64, and the endless press or pressing belt 102, are revolvingly driven at the same conveying speed v.

An infeeding conveyor 124 structured as a belt conveyor is arranged directly upstream of the first conveyor 12, for the purpose of supplying the printed products 30 arranged in the imbricated formation S to the first conveyor 12. Furthermore, an outfeed device or conveyor 126 also structured as a belt conveyor is arranged directly downstream of the first conveyor 12 for the purpose of delivering the printed products 30, conveyed by the first conveyor 12 and not diverted to the second conveyor 18, to a not particularly illustrated process or processing station. In the region of the infeeding conveyor 124, there is provided a generally known counter or counting device 128 for counting the printed products 30 supplied to the first conveyor 12.

In the interest of completeness, reference is made to FIGS. 1 and 4 and the second conveying arm 24 which comprises a tongue or blade 130 protruding in the direction towards the step or shoulder 32 for the purpose of deflecting or diverting from below the leading or downstream edge 30' of the printed product 30 to be seized by the transfer conveyor 20 when the conveying entrance 26 is brought to its working position.

Having now had the benefit of the foregoing description of the exemplary embodiment illustrated in FIGS. 1 and 2, the mode of operation of the switch-like device 10 for selectively or alternatively transferring printed products 30 from the first conveying path 16 onto the second conveying path 17 is hereinafter described in conjunction with FIGS. 3 through 7, and is as follows:

FIGS. 3 through 7 schematically show, in a side view and in an enlarged illustration, the region of the step or shoulder 32 of the first conveyor 12 and the region of the conveying entrance 26 of the transfer or carry-over conveyor 20.

Figure 3:
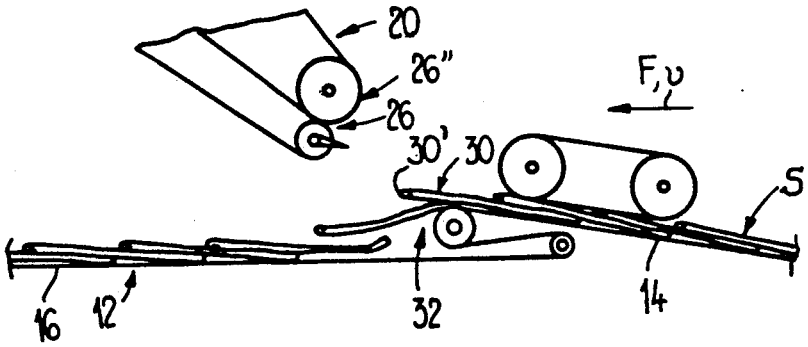
FIG. 3 schematically shows in a side view and in an enlarged illustration a section or part of the conveying device according to FIG. 1 in a first operating phase.

According to FIG. 3, the printed products 30 supplied in the imbricated formation or array S and reposing on the conveying-active upper run 14 of the first conveyor 12 are conveyed over the step 32 and along the first conveying path 16 to the outfeed device or conveyor 126, as also seen by reverting to FIG. 1. The conveying entrance 26 is located in a stand-by position 26'' in the proximity of the step or shoulder 32. Such stand-by position 26'' is rendered possible in that the piston-and-cylinder unit 60' pivots the driving lever 58 to an intermediate position which is located between the two end positions thereof depicted in FIG. 1. In this stand-by position 26'', the conveying entrance 26 is still so far remote from the step or shoulder 32 that the leading or downstream edges or regions 30', which by virtue of the inherent stiffness of the printed products 30 freely protrude over the step or shoulder 32, do not reach the conveying entrance 26, but are rather further conveyed under the latter and along the first conveying path 16. However, it is to be observed that the leading or downstream edge or region of each printed product 30 at the step or shoulder 32 is elevationally disengaged or separated from the preceding and descending printed product 30 for a certain length of time.

Figure 4:
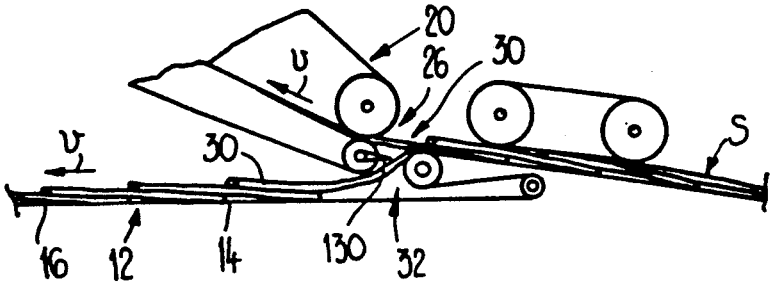
FIG. 4 schematically shows the section or part of the conveying device according to FIG. 3 in a second operating phase.
Figure 5:
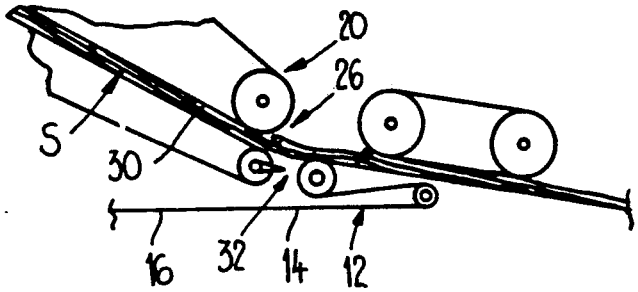
FIG. 5 schematically shows the section or part of the conveying device according to FIG. 3 in a third operating phase.
Figure 6:
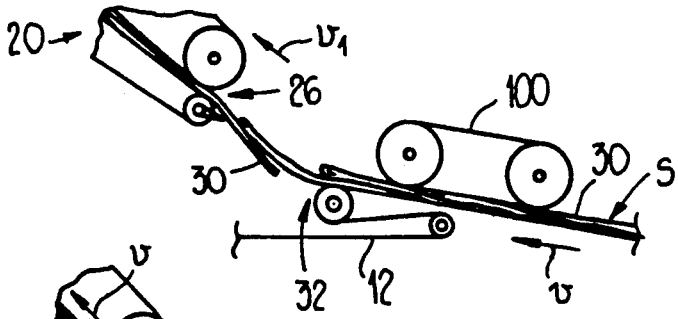
FIG. 6 schematically shows the section or part of the conveying device according to FIG. 3 in a fourth operating phase.

Now, as soon as printed products 30 are to be supplied to the second conveyor 18 defining the second conveying path 17, the conveying entrance 26 is taken to the working position depicted in FIG. 4. This is accomplished by totally retracting the piston rod 60. The printed product 30 conveyed at this very moment over the descending step or shoulder 32 is directed to the conveying entrance 26 in that the tongue or blade 130 is inserted between the aforesaid printed product 30 and the respective preceding printed product 30 descending from the step or shoulder 32. Since the conveying speed v of the transfer or carry-over conveyor 20 is exactly the same as the conveying speed v of the first conveyor 12, the imbricated formation S is retained or maintained for the printed products outbound to the second conveyor 18, as is evident by referring to FIG. 5. On the other hand, the printed products 30 located downstream of the step or shoulder 32 and reposing on the upper conveying-active run 14 are further conveyed along the first conveying path 16 at the unvaried predetermined conveying speed v. The transfer or carry-over conveyor 20 now remains in this working position as long as printed products 30 are to be fed to the second conveying path 17.

The inbound or infed printed products 30 are counted by means of the counter or counting device 128, shown in FIG. 1. By virtue of knowing the conveying speed v, the conveying entrance 26 can be drawn away from its working position subsequent to a precisely predetermined number of printed products 30 for the purpose of interrupting the feed to the second conveying path 17 after the exact given number of printed products 30 have been diverted. During displacement of the conveying entrance 26 from the working position to the withdrawal position 26' thereof, which displacement is accomplished by fully extending the piston rod 60 of the piston-and-cylinder unit 60', the conveying entrance 26 is obliquely and upwardly moved away from the step 32 at a speed of movement $v_1$ which exceeds the conveying speed v of the supplied printed products 30. In this manner, the printed product 30 last seized by the conveying entrance 26 is drawn off from under the next following or trailing printed product 30, whereby the retaining or hold-back device 100 prevents the next following or trailing printed product 30 from being entrained, as best seen by referring to FIG. 6. Furthermore, by virtue of this higher speed of movement $v_1$ for withdrawing the conveying entrance 26, there is prevented with certainty that the first printed product 30 to be again supplied to the outfeed device or conveyor 126 can get to the conveying entrance 26.

Figure 7:
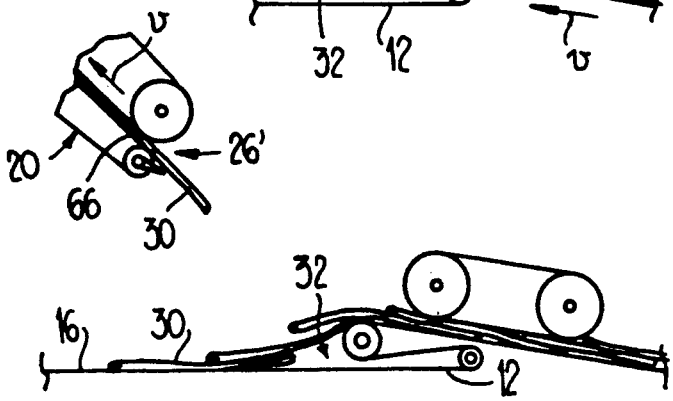
FIG. 7 schematically shows the section or part of the conveying device according to FIG. 3 in a fifth operating phase.

With attention now invited to the last FIG. 7, the following inbound or infed printed products 30 are again conveyed along the first conveying path 16 to the outfeed device or conveyor 126, and the printed products 30 held in the conveying gap 66 of the transfer or carry-over conveyor 20 are conveyed at the unvaried speed v and with unchanged spacings in the imbricated formation S to the second conveyor 18. The conveying entrance 26 can now remain in its withdrawal position 26' or, in case further printed products 30 are to be diverted to the second conveying path 17, can be again taken to the stand-by position 26'' depicted in FIG. 3.

It is to be observed that the conveying speed v of the printed products 30 can be always constant or invariable, irrespective of the position of the transfer or carry-over conveyor 20. It is unnecessary to raise the conveying speed v of the transfer conveyor 20 and of the second conveyor 18 for the purpose of achieving the separation or detachment of successive printed products 30 at the step 32. Furthermore, the conveying stretch or route 34 between the conveying entrance 26 and the conveying exit 20' remains approximately the same, irrespective of the mutual position of the conveying arms 22 and 24, so that the imbricated formation or array of the printed products 30 is preserved or maintained also during the movement or displacement of the transfer conveyor 20. Since the arc of belt wrap or contact at the deflection roller 48 increases upon reduction of the lower angle between the two conveying arms 22 and 24, and in view of the fact that the roll or roller 54' at the conveying exit 20' of the transfer conveyor 20 is driven at a constant rotational speed, the speed of the conveying-active upper run 50 in the region between the conveying entrance 26 and the deflection roller 48 is slightly increased while taking the conveying entrance 26 back to the withdrawal position 26', such slight increase in speed additionally assisting the separation of the printed products 30 at the step 32 while retaining the imbricated formation or array S in the region or area of the transfer or carry-over conveyor 20.

With the switch-like conveying device 10 structured according to the invention, it is also possible to separate or detach only single or individual printed products 30, for instance waste-paper, from the infed imbricated formation S. For this purpose, the conveying entrance 26 is brought to its working position only for the length of time required to seize such single or individual printed product 30.

It is of course also possible to structure the transfer or carry-over conveyor differently than as depicted in FIGS. 1 and 2. Thus, for instance, it is conceivable to provide each of the two conveying arms 22 and 24 as a belt conveyor of its own, or to structure the guidance or slaved control for the pressing or hugger belt or band in quite a different manner. Furthermore, the presence of a step 32 or equivalent structure is not imperative. After all, a transfer or carry-over conveyor provided with an appropriately designed or structured tongue or blade can be readily inserted in the shingled formation of printed products. As the case may be, it is also possible to dispense with the retaining or hold-back device 100.

While there are shown and described present preferred embodiments of the invention, it is to be understood that the invention is not limited thereto, but may be otherwise variously embodied and practiced within the scope of the following claims. ACCORDINGLY,

What I claim is:

1. An apparatus for selectively transferring flexible flat products, especially printed products such as newspapers, magazines and the like, from an imbricated formation conveyed along a first conveying path onto a second conveying path, comprising:

a first conveyor defining the first conveying path;

a second conveyor defining the second conveying path;

a transfer conveyor provided between said first conveyor and said second conveyor;

said transfer conveyor having a conveying entrance facing said first conveyor and a stationary conveying exit facing said second conveyor;

said transfer conveyor comprising two conveying arms arranged in tandem and pivotably connected with each other;

said two conveying arms comprising belt conveyors and including a first conveying arm and a second conveying arm;

said first conveying arm having a conveying-active end;

said first conveying arm being arranged directly upstream of said second conveyor and stationarily pivotably mounted in the region of said conveying-active end;

said second conveying arm having a free end;

said conveying entrance of said transfer conveyor being provided at said free end of said second conveying arm and having a working position adjacent to said first conveyor and a withdrawal position remote from said first conveyor;

a driving arrangement;

said two conveying arms being pivotably in a knee-like manner by means of said driving arrangement to take said conveying entrance at said free end of said second conveying arm to said working position for separating printed products from the imbricated formation, and to said withdrawal position for terminating the separation of printed products from the imbricated formation;

pressing means allocated to said conveying arms;

said pressing means comprising at least one endless revolving pressing belt serving to form a conveying gap in conjunction with said conveying arms;

said transfer conveyor having a conveying direction; and roller means for guiding and retaining said pressing means in said conveying direction of said transfer conveyor such that said roller means is stationary with respect to said conveying arms, irrespective of the pivoting position of said conveying arms.

2. The apparatus as defined in claim 1, wherein:

said two conveying arms structured as belt conveyors are provided with a mutual revolving endless conveyor belt.

3. The apparatus as defined in claim 2, further including:

a defection roller;

means for pivotably connecting said two conveying arms with each other said mutual revolving endless conveyor belt having a conveying-active run and said conveying-active run being guided around said deflection roller in the region of said pivot connection.

4. The apparatus as defined in claim 3, which comprises compensating means acting on the respective run not active to compensate for changes in length of the respective active run.

5. The apparatus as defined in claim 3, wherein:

said at least one endless revolving pressing belt of said pressing means comprises a pressing belt common to both said conveying arms;

said pressing belt 50' having a pressing-active run; and said pressing-active run bearing upon said conveying-active run of said endless conveyor belt of said two conveying arms and thereby forming said conveying gap.

6. The apparatus as defined in claim 3, which comprises compensating means acting on the respective run not active to compensate for changes in length of the respective active run.

7. An apparatus for selectively transferring flexible flat products, especially printed products such as newspaper, magazines and the like, from an imbricated formation conveyed along a first conveying path onto a second conveying path, comprising:

a first conveyor defining the first conveying path;

a second conveyor defining the second conveying path;

a transfer conveyor provided between said first conveyor and said second conveyor;

said transfer conveyor having a conveying entrance facing said first conveyor and a stationary conveying exit facing said second conveyor;

said transfer conveyor comprising two conveying arms arranged in tandem and pivotably connected with each other;

said two conveying arms comprising belt conveyors and including a first conveying arm and a second conveying arm;

said first conveying arm having a conveying-active end;

said first conveying arm being arranged directly upstream of said second conveyor and stationarily pivotably mounted in the region of said conveying-active end;

said second conveying arm having a free end;

said conveying entrance of said transfer conveyor being provided at said free end of said second conveying arm and having a working position adjacent to said first conveyor and a withdrawal position remote from said first conveyor;

a driving arrangement;

said two conveying arms being pivotable in a knee-like manner by means of said driving arrangement to take said conveying entrance at said free end of said second conveying arm to said working position for separating printed products from the imbricated formation, and to said withdrawal position for terminating the separation of printed products from the imbricated formation;

pressing means allocated to said conveying arms;

said pressing means comprising at least one endless revolving pressing belt serving to form a conveying gap in conjunction with said conveying arms;

said transfer conveyor having a conveying direction; and means for guiding and retaining said pressing means in said conveying direction of said transfer conveyor such that said pressing means is stationary with respect to said conveying arms, irrespective of the pivoting position of said conveying arms wherein said two conveying arms structured as belt conveyors are provided with a mutual revolving endless conveyor belt;

a defection roller;

means for pivotably connecting said two conveying arms with each other, said mutual revolving endless conveyor belt having a conveying-active run and said conveying-active run being guided around said deflection roller in the region of said pivot connection wherein said at least one endless revolving pressing belt of said pressing means comprises a pressing belt common to both said conveying arms; said pressing belt having a pressing-active run; and said pressing-active run bearing upon said conveying-active run of said endless conveyor belt of said two conveying arms and thereby forming said conveying gap;

deflection rollers provided for said endless conveyor belt;

said first conveying arm and said second conveying arm comprising respective bearing shields for supporting said deflection rollers;

said bearing shields of said second conveying arm being pivotably mounted at said bearing shields of said first conveying arm;

said guiding and retaining means comprising linkage means having oppositely situated ends and pivotably acting at one of said ends upon said bearing shields of said first conveying arm;

said linkage means being connected at said one of said ends with said bearing shields so as to define first connection locations;

said guiding and retaining means including bearing members pivotably arranged at the other one of said ends of said linkage means, and means for pre-biasing said bearing members in the direction towards said bearing shields of said conveying arms;

said linkage means being connected at said other one of said ends with said bearing members so as to define second connection locations;

said bearing shields for supporting said defection rolls for said endless conveyor belt defining a lengthwise direction;

said bearing members being structured in a shield-like manner and being substantially stationary in said lengthwise direction of said bearing shields with respect to the latter;

said guiding and retaining means including rollers provided at said bearing members, at said first connection locations and at said second connection locations; and said pressing belt related to both said conveying arms being guided around said rollers.

8. An apparatus as defined in claim 7, wherein:

said driving arrangement comprises a drivable driving lever for moving said conveying arms;

said drivable driving lever having oppositely situated ends;

said drivable driving lever acting at one of said ends upon one of said second conveying arm and one of said bearing shields related to the latter; and said driving lever being stationarily pivotably supported at the other one of said oppositely situated ends.

9. The apparatus as defined in claim 8, further including:

a stepped roller;

a further deflection roller;

said first conveyor comprising a belt conveyor having a conveying-active upper run traveling in a predetermined conveying direction;

each printed product in the inbound imbricated formation having a leading edge;

said conveying-active upper run wrapping first around said stepped roller and subsequently in the direction opposite to said predetermined conveying direction around said further deflection roller for the purpose of forming a descending step as viewed in said predetermined conveying direction and thus for the purpose of exposing said leading edge of the respective printed product conveyed over said descending step;

said conveying-active upper run of said first conveyor being directed so as to ascend towards said stepped roller; and said conveying entrance transferred to said working position to separate and seize said printed product conveyed over said descending step being arranged in neighboring relationship to and downstream of said descending step, as viewed in said predetermined conveying direction.

10. The apparatus as defined in claim 9, further including:

a retaining device for preventing the entrainment of printed products not seized by said second conveying arm while transferring said conveying arms from a location corresponding to said working position of said conveying entrance to a location corresponding to said withdrawal position.

11. The apparatus as defined in claim 10, wherein:

said retaining device comprises a pressing element co-acting with said conveying-active upper run of said first conveyor.

12. The apparatus as defined in claim 11, further including:

a common drive defining a predetermined conveying speed;

first coupling means for connecting said first conveyor and said conveying arms to said common drive;

second coupling means for connecting said driven conveying arms with said second conveyor;

third coupling means for connecting said pressing element of said retaining device to said common drive;

fourth coupling means for connecting said driven conveying arms with said linkage means for the purpose of driving said pressing belt; and all coupling means serving to convey the printed products at said predetermined conveying speed.

13. The apparatus as defined in claim 10, wherein:

said conveying entrance of said transfer conveyor has a stand-by position located between said working position and said withdrawal position;

said stand-by position being provided in the proximity of said working position of said conveying entrance; and said conveying arms being brought from said location corresponding to said withdrawal position to a location corresponding to said stand-by position in the event of further supply of printed products to the second conveyor.

14. The apparatus as defined in claim 13, further including:

driving means for driving said first conveyor at a predetermined conveying speed;

said driving means serving to drive said conveying arms structured as belt conveyors at a conveying speed substantially corresponding to said predetermined conveying speed; and said driving arrangement serving to take said conveying entrance of said second conveying arm from said working position to said withdrawal position at a speed of movement which exceeds said predetermined conveying speed.

15. The apparatus as defined in claim 14, further including:

a common drive constituting said driving means;

first coupling means for connecting said first conveyor and said conveying arms to said common drive;

second coupling means for connecting said conveying arms with said second conveyor; and said first and second coupling means rendering possible conveyance of the printed products at said predetermined conveying speed.

16. An apparatus for selectively transferring flexible flat products, especially printed products such as newspapers, magazines and the like, from an imbricated formation conveyed along a first conveying path onto a second conveying path, comprising:

a first conveyor defining the first conveying path;

a second conveyor defining the second conveying path;

a transfer conveyor provided between said first conveyor and said second conveyor;

said transfer conveyor having a conveying entrance facing said first conveyor and a stationary conveying exit facing said second conveyor;

said transfer conveyor comprising two conveying arms, arranged in tandem and pivotably connected with each other;

said two conveying arms comprising belt conveyors and including a first conveying arm and a second conveying arm;

said first conveying arm having a conveying-active end;

said first conveying arm being arranged directly upstream of said second conveyor and stationarily pivotably mounted in the region of said conveying-active end;

said second conveying arm having a free end;

said conveying entrance of said transfer conveyor being provided at said free end of said second conveying arm and having a working position adjacent to said first conveyor and a withdrawal position remote from said first conveyor;

a driving arrangement;

said two conveying arms being pivotable in a knee-like manner by means of said driving arrangement to take said conveying entrance at said free end of said second conveying arm to said working position for separating printed products from the imbricated formation, and to said withdrawal position for terminating the separation of printed products from the imbricated formation;

pressing means allocated to said conveying arms, said pressing means comprising at least one endless revolving pressing belt serving to form a conveying gap in conjunction with said conveying arms;

said transfer conveyor having a conveying direction;

means for guiding and retaining said pressing means in said conveying direction of said transfer conveyor such that said pressing means retain their position with respect to said conveying arms, irrespective of the pivoting position of said conveying arms, wherein said conveying arms structured as belt conveyors are provided with a mutual revolving endless conveyor belt;

a deflection roller;

means for pivotably connecting said two conveying arms with each other forming a pivot connection said mutual revolving endless conveyor belt having a conveying-active run and said conveying-active run being guided around said deflection roller in the region of said pivot connection, wherein said at least one endless revolving pressing belt of said pressing means comprises a pressing belt common to both said conveying arms, said pressing belt has a pressing-active run, and said pressing-active run bears upon said conveying-active run of said endless conveyor belt of said two conveying arms and thereby forms said conveying gap; and compensating means acting on the respective run not active to compensate for changes in length of the respective active run.

* * * * *